US009519266B2

(12) United States Patent
Sasaki

(10) Patent No.: US 9,519,266 B2
(45) Date of Patent: Dec. 13, 2016

(54) DUCT AND IMAGE FORMING APPARATUS USING THE SAME

(71) Applicant: Shoji Sasaki, Kanagawa (JP)

(72) Inventor: Shoji Sasaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/982,045

(22) Filed: Dec. 29, 2015

(65) Prior Publication Data

US 2016/0195848 A1 Jul. 7, 2016

(30) Foreign Application Priority Data

Jan. 7, 2015 (JP) ..... 2015-001333

(51) Int. Cl.
*G03G 21/20* (2006.01)
*F24F 7/06* (2006.01)

(52) U.S. Cl.
CPC ..... *G03G 21/206* (2013.01); *F24F 7/065* (2013.01)

(58) Field of Classification Search
CPC ..... G03G 21/20; G03G 21/206
USPC ..... 399/92, 93
See application file for complete search history.

(56) References Cited

U.S. PATENT DOCUMENTS 8,571,436 B2 * 10/2013 Yamamiya ..... G03G 21/206 137/804

FOREIGN PATENT DOCUMENTS

JP 8-286577 11/1996
JP 2012-246070 12/2012

* cited by examiner

*Primary Examiner* — Hoang Ngo
(74) *Attorney, Agent, or Firm* — Harness, Dickey & Pierce, P.L.C.

(57) ABSTRACT

A duct includes a suction port being connected to a first separate duct from a first direction, an exhaust port being connected to a second separate duct from the first direction, and a passage formed to extend from the suction port to the exhaust port. At least one of the suction port and the exhaust port includes a first opening portion that is opened to incline to the first direction and second opening portions at both ends of the first opening portion, the second opening portions that are opened in a transverse direction to the first direction.

9 Claims, 4 Drawing Sheets

DUCT AND IMAGE FORMING APPARATUS USING THE SAME

CROSS-REFERENCE TO RELATED APPLICATION

This application is based upon and claims the benefit of priority to Japanese Patent Application No. 2015-001333 filed on Jan. 7, 2015, the entire disclosures of which are incorporated herein by reference.

BACKGROUND

Technical Field

The disclosure relates to an image forming apparatus such as copying machines, printers, facsimile machines, complex machines thereof, and a duct installed on the image forming apparatus and configured to exhaust or suck air, or release heat from the image forming apparatus.

Description of Related Art

In a conventional image forming apparatus such as a copying machine or printer, there is known a technology of exhausting ozone-less air by collecting (removing) ozone by an ozone filter while flowing ozone occurred in a charging device to charge a photoconductor drum (image bearer) together with air in a duct, and of heat-releasing while flowing heat occurred in a fixing device to heat and fix a toner image carried on a recording medium (paper) together with air in a duct (see, for example, Japanese Patent Application Publication No. 2012-246070).

In such a duct in which the image forming apparatus is installed, in a case where a passage is formed by connecting two duct parts, the passage is formed by a technology in which both opening portions (an exhaust port of one duct part and a suction port of another duct part) of the duct parts, which are connection portions, are opened to incline to a connection direction (see, for example, Japanese Patent Application Publication No. 2012-246070).

SUMMARY

At least one aspect of this disclosure provides a duct according to one embodiment of the disclosure includes a suction port being connected to a first separate duct from a first direction, an exhaust port being connected to a second separate duct from the first direction, and a passage formed to extend from the suction port to the exhaust port. At least one of the suction port and the exhaust port includes a first opening portion that is opened to incline to the first direction and second opening portions at both ends of the first opening portion, the second opening portions that are opened in a transverse direction to the first direction.

DETAILED DESCRIPTION OF EMBODIMENTS

Embodiments according to the disclosure will be described hereinafter with reference to the accompanying drawings.

Figure 1:
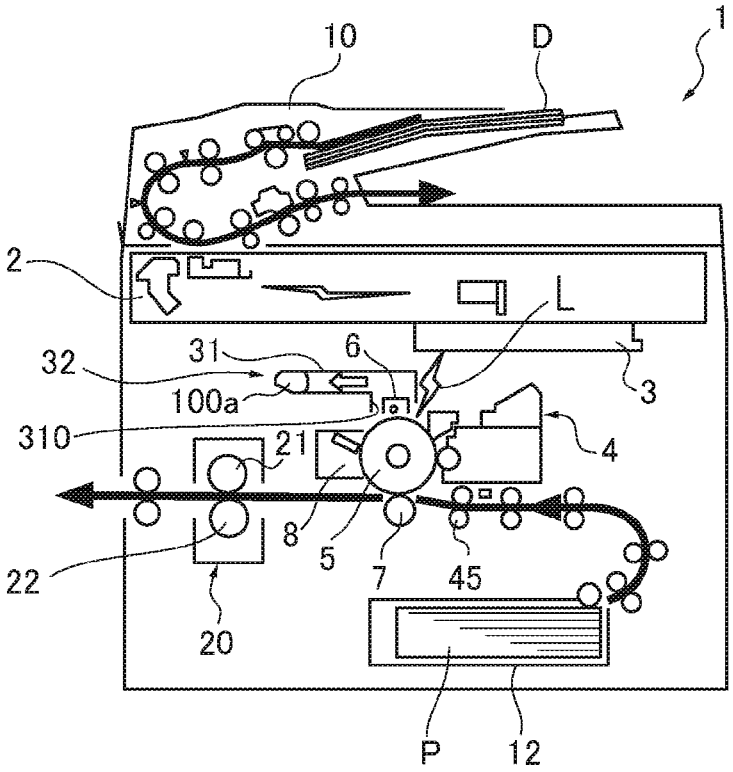
FIG. 1 is an entire configuration view showing an image forming apparatus according to a first embodiment of the disclosure.

An image forming apparatus 1 according to an embodiment of the disclosure is first described. As illustrated in FIG. 1, the image forming apparatus 1 is applied to, for example, a copying machine. The copying machine includes an original reading section 2 that optically reads image information of an original D, an exposure device 3 that irradiates a photoconductor drum 5 as an image bearer with exposure light L based on the image information read in the original reading section 2, a developing device 4 that develops a latent image formed on the photoconductor drum 5 and forms a toner image (imaged image), a charging device (charger) 6 that charges a surface of the photoconductor drum 5, and a transfer device (transfer nip) 7 that transfers the toner image formed on the photoconductor drum 5 to a recording medium P.

The copying machine further includes a cleaning device 8 that removes untransferred residue toner remaining on the photoconductor drum 5, an original conveying section 10 that conveys the set original D to the original reading section 2, a feeding section (feeding cassette) 12 that contains a plurality of recording media (papers) P, a fixing device 20 that fixes the toner image (unfixed image) on the recording medium P, a fixing roller 21 installed on the fixing device 20, a pressure roller 22 installed on the fixing device 20, a first duct (body side duct) 31 that decomposes ozone occurred in the charging device 6 and exhausts it to an exterior of the image forming apparatus 1, and a timing roller (registration roller) 45 that conveys the recording medium P to the transfer device (transfer nip) 7.

Referring to FIG. 1, a usual operation in forming an image in the image forming apparatus is described. The original D is first conveyed from an original table and passes the original reading section 2, as shown in a direction of arrow in FIG. 1 by conveying rollers of the original conveying section 10. At this time, image information of the original D is optically read in the original reading section 2 as the original passes through the original reading section 2. Then, the optical image information read in the original reading section 2 is converted into an electrical signal, thereafter the electrical signal is sent to the exposure device (writing device) 3. Exposure light L (laser light) based on the image information of the electrical signal is emitted from the exposure device 3 to the photoconductor drum 5.

On the other hand, the photoconductor drum as the image bearer rotates clockwise as viewed in FIG. 1, and an image (toner image) corresponding to the image information is formed on the photoconductor drum 5 through predetermined image forming processes (charging process, exposure process, developing process). Thereafter, the image formed on the photoconductor drum 5 is transferred on the conveyed recording medium P at a position (transfer nip) facing the transfer device 7 by the timing roller 45.

More specifically, the photoconductor drum 5 is rotated clockwise as viewed in FIG. 1. The surface of the photoconductor drum 5 is evenly charged at a position facing the charging device 6 (charging process). Charging electric potential is thus formed on the photoconductor drum 5. Here, in the embodiment, a known corona discharge-type charger is used as the charging device 6. After that, the charged surface of the photoconductor drum 5 reaches a position where the exposure light L is emitted. An electrostatic latent image based on the image information read in the original reading section 2 is then formed on the surface of the photoconductor drum 5 (exposure process). Thereafter, the surface of the photoconductor drum 5, on which the electrostatic latent image is formed reaches a position facing the developing device 4. Toner is supplied from the developing device 4 onto the photoconductor drum 5 to develop the latent image on the photoconductor drum 5 (developing process).

After the developing process, the surface of the photoconductor drum 5 reaches the position (transfer nip) facing the transfer device 7. At the position facing the transfer device 7, the toner image formed on the photoconductor drum 5 is transferred on the recording medium P (transfer process). After the transfer process, the surface of the photoconductor drum 5 reaches a position facing the cleaning device 8. At the position facing the cleaning device 8, the untransferred toner remaining on the photoconductor drum 5 is removed and collected (cleaning process). Thereafter, the surface of the photoconductor drum 5 passes through a neutralization section (not shown), and a series of image forming processes regarding the photoconductor drum 5 are completed.

On the other hand, the recording medium P conveyed at the position of the transfer device 7 (transfer nip) is operated as described below. The uppermost one of the plurality of recording media P contained in the feeding section 12 is first fed to a conveyance route where a plurality of conveying rollers (not shown) is located, by feeding rollers (not shown). Thereafter, the recording medium P reaches a position of the timing roller 45. The recording medium P reached the position of the timing roller 45 is adapted to match a timing so as to align with an image formed on the photoconductor drum 5 and transferred to the transfer device 7 (transfer nip).

The recording medium P after the transfer process reaches the fixing device 20 through the conveyance route after passing through the position of the transfer device 7. The recording medium P reached the fixing device 20 (which is the recording medium P in which an unfixed image is carried) is sent between the fixing roller 21 and the pressure roller 22. A heater as a heat source is contained in the fixing roller. The unfixed toner image as an image is fixed on the recording medium P by heat from the fixing roller and a pressure receiving from the fixing roller 21 and the pressure roller 22. The recording medium P in which the toner image is fixed is sent out from the nip position between the fixing roller 21 and the pressure roller 22, and thereafter is discharged from the copying machine 1. The series of image forming processes described above are thus completed.

In the embodiment, although the corona discharge-type charger that easily generates ozone has been used as the charging device 6, a known charging roller that is hard to generate ozone may be used as the charging device 6. Moreover, in the embodiment, the known heater-type fixing device that uses the heater as the heat source has been used as the fixing device 20, a known electromagnetic induction heating-type fixing device in which an exciting coil is provided or known resistance heating-type in which a resistance heating element is provided may be used at the fixing device 20.

Figure 4:
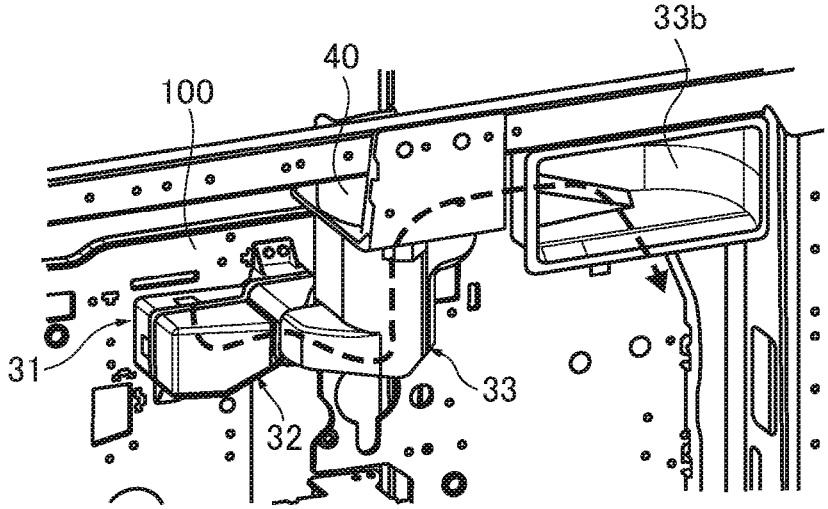
FIG. 4 is a perspective view showing a state where a separate duct is provided on the body side plate shown in FIG. 3.
Figure 5:
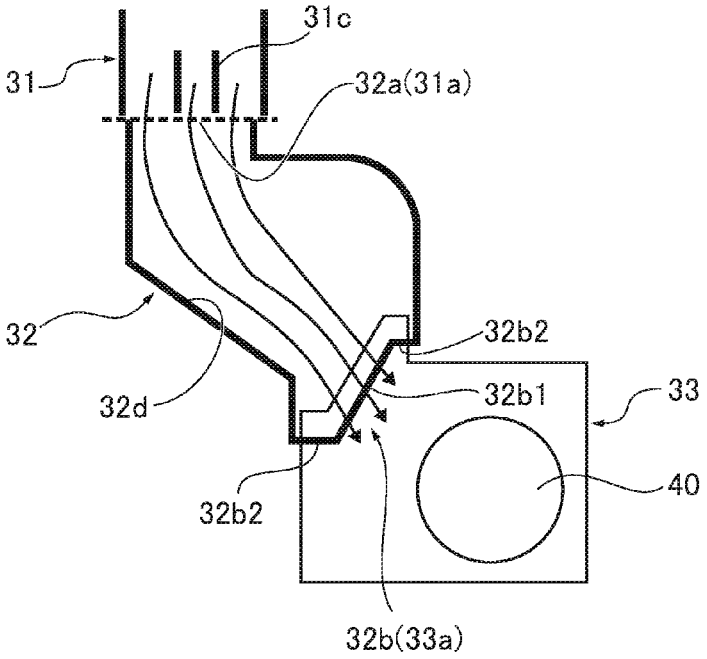
FIG. 5 is a schematic view showing a state where the duct is connected to the body side duct and the separate duct.

Next, a configuration and an operation of a duct 32 used in the image forming apparatus 1 described in the embodiment are described. Specifically, an exhaust device is provided in the image forming apparatus 1. The exhaust device includes an exhaust route in which three ducts of a first duct 31, a second duct 32, and a third duct 33 are connected, as illustrated in FIGS. 1, 4, and 5. The second duct 32 is referred to as the duct according to the disclosure. The third duct 33 is referred to as a separate duct in the specification.

An ozone filter (not shown) to collect ozone occurred in the charging device 6 is provided in a middle of the exhaust route. In the embodiment, the ozone filter is formed integrally with the third duct 33 and a suction fan 40. The ozone filter and the suction fan 40 are placed in the third duct 33 of a middle of the exhaust route to collet ozone. A known ozone filter may be used as the ozone filter. The ozone occurred in the charging device 6 by a high voltage discharge is exhausted through the exhaust route of the three ducts 31 to 33 to an exterior while being removed (collected) by the ozone filter, thereby exhausting ozone-less air to an exterior of the image forming apparatus 1.

Figure 2:
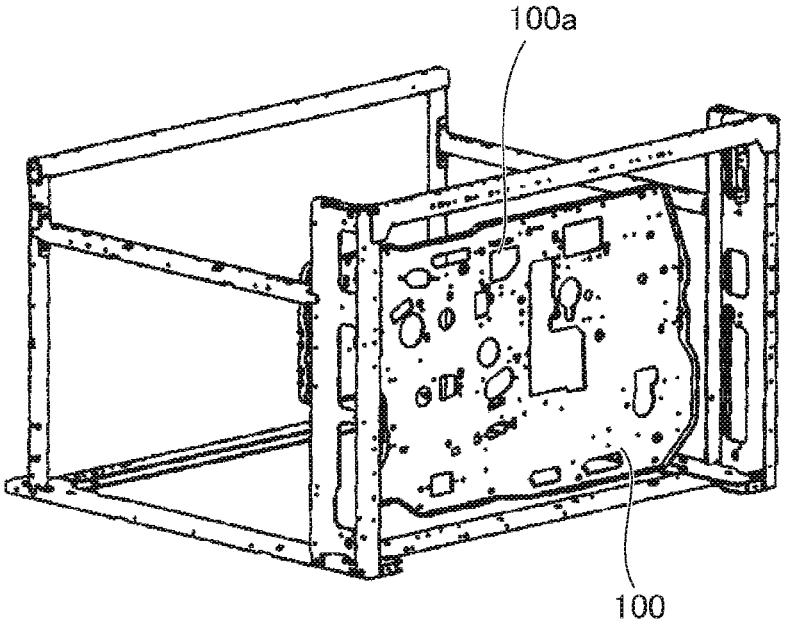
FIG. 2 is a perspective view showing a body frame of the image forming apparatus.

More specifically, as shown in FIG. 2, the image forming apparatus 1 includes a body side plate 100 that functions as a part of a body frame (casing) and is provided on a rear surface side of the image forming apparatus 1. The first duct 31 as a body side duct is provided on an inner side (area surrounded by the body frame) of the body side plate 100. The first duct (body side duct) 31 has a suction port 310 provided at a position facing the charging device 6.

Figure 3:
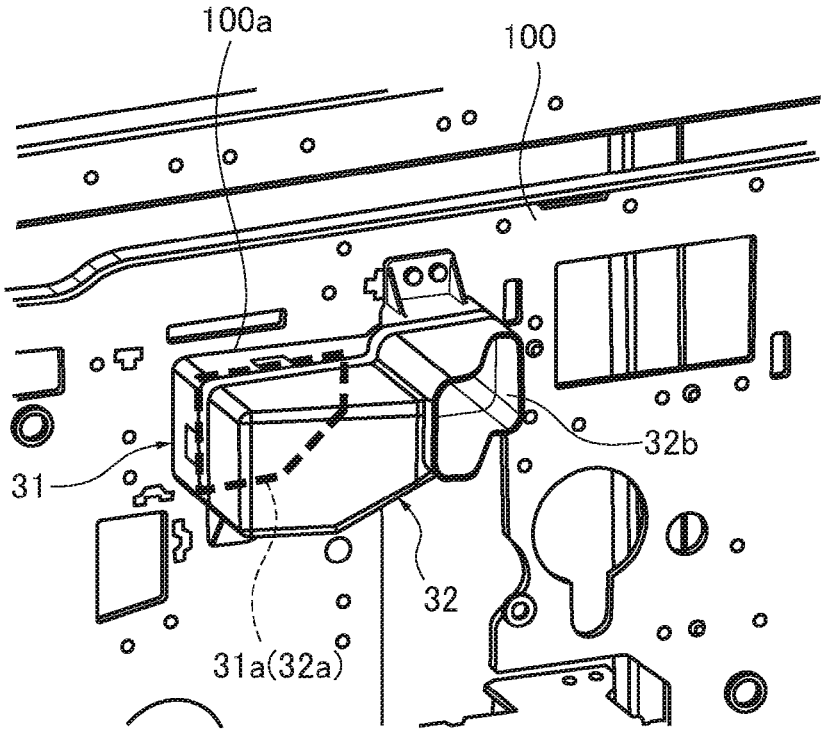
FIG. 3 is a perspective view showing a state where a duct is provided on a body side plate on which a body side duct is provided.

Referring to FIG. 3, the first duct 31 has an exhaust port 31*a* which is formed to protrude to an outside (rear surface side of the image forming apparatus 1) of the body side plate 100 through an opening portion 100*a* provided in the body side plate 100. As is clear from FIG. 5, the duct, that is to say, the second duct 32 has a suction port 32*a* which communicates with the exhaust port 31*a* of the first duct (body side duct) 31 protruding to the outside of the body side plate 100. The second duct 32 has an exhaust port 32*b* which communicates with a suction port 33*a* of the third duct 33 as the separate duct. The third duct 33 has an exhaust port 33*b* (see FIG. 4) which is opened toward an outside of the rear surface side of the image forming apparatus 1. The suction fan 40 is disposed in a middle of the third duct 33 (see FIG. 5). Note that one rib or a plurality of ribs 31*c* to adjust air flow exhausted from the first duct 31 to the second duct 32 is provided at a position close to the exhaust port 31*a* of the first duct 31 (see FIG. 5).

With such a configuration, the ozone occurred at the position of the charging device 6 is suctioned together with air from the suction port 310 of the first duct 31 by the suction of the suction fan 40. The suctioned ozone is collected and removed by the ozone filter while passing through the first to third ducts 31 to 33, thereby exhausting the ozone-less air from the exhaust port 33*b* of the third duct 33 to the exterior of the image forming apparatus 1.

The second duct 32 is configured to form a flow passage from the suction port 32*a* to the exhaust port 32*b*, similarly to the other two ducts 31 and 33 and disposed to relay between the first duct 31 and the third duct 33. In this case, the configuration of one exhaust route by the connection of the plurality of ducts 31 to 33 makes it possible to easily assemble these ducts even if a complicate exhaust route extending from the charging device 6 to the exterior of the image forming apparatus 1 must be formed.

Here, the suction port 33*a* of the third duct (separate duct) 33 is connected to the exhaust port 32*b* of the second duct (duct) 32 from a predetermined direction (transverse direction, for example, a substantially perpendicular direction to the body side plate 100, a substantially perpendicular direction to the paper surface of FIG. 1, and an up and down direction in FIG. 5). More specifically, the third duct (separate duct) 33 is connected to the second duct 32 as shown in FIG. 4 as the foregoing predetermined direction (connection direction) which is the substantially perpendicular direction to the body side plate 100 (state of FIG. 3) in a state where the second duct 32 is connected to the first duct (body side duct) 31 (state shown in FIG. 3).

Figure 6A:
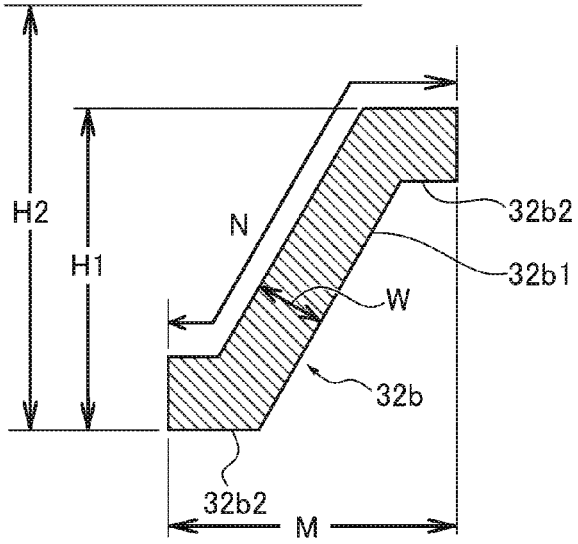
FIG. 6A is a schematic view showing an exhaust port of the duct.

Referring to FIGS. 5, 6A, and 3, the exhaust port 32*b* of the second duct (duct) 32 includes a first opening portion 32*b*1 (inclined portion) that opens to be inclined to the foregoing predetermined direction (connection direction) and second opening portions 32*b*2 (straight portions) that open in a transverse direction, for example, a substantially perpendicular direction to the predetermined direction (connection direction) and are connected to both sides of the first opening portion 32*b*1 in an inclined direction thereof. More specifically, the suction port 32*a* of the second duct (duct) 32 is formed to open in a transverse direction, for example, a substantially perpendicular direction to the predetermined direction (connection direction). In other words, the suction port 32*a* is positioned parallel substantially to a mounting surface of the body side plate 100. The exhaust port 32*b* of the second duct 32 is composed of the first opening portion 32*b*1 that is inclined to the suction port 32*a* and the second opening portions 32*b*2 substantially parallel to the suction port 32*a*. In addition, the first opening portion 32*b*1 is formed to open toward a side where the suction port 32*a* is formed.

The suction port 32*a* and the exhaust port 32*b* of the second duct 32 are not arranged so as to face each other in the front. In other words, a passage of the second duct 32 is bent from the suction port 32*a* to the exhaust port 32*b*. The first opening portion 32*b*1 (inclined portion) of the exhaust port 32*b* is configured to open in a substantially perpendicular direction to the bent passage. Furthermore, the third duct (separate duct) 33 has a suction port 33*a* provided to be connected to the first opening portion 32*b*1 and the second opening portions $32b_2$ in the exhaust port 32*b* of the second duct 32. The suction port 33*a* of the third duct 33 is configured to fit in the exhaust port 32*b* corresponding to a shape of the exhaust port 32*b* of the second duct 32, the shape having the first opening portion 32*b*1 and the second opening portions 32*b*2.

In this way, in the embodiment, the second duct 32 is configured to form the bent passage because the suction port 32*a* and the exhaust port 32*b* cannot be arranged to face each other in the front from the reason for a layout such as arrangement of other structural members in the image forming apparatus 1. The exhaust port 32*b* is formed to be substantially perpendicular to the passage such that the air is exhausted from the bent passage smoothly.

Figure 6B:
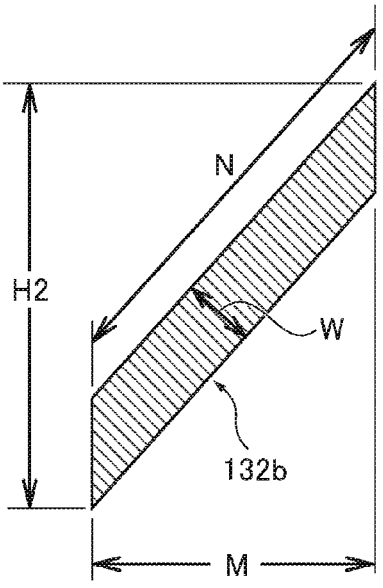
FIG. 6B is a schematic view showing the duct where an exhaust port is formed by only an inclined portion.

If there is such limitation, as shown in FIG. 6B, when an exhaust port 132*b* to which a separate duct is connected is opened to be inclined to a connection direction, in other words, when the exhaust port 132*b* is configured by only an inclined portion, a length H2 of only an inclined amount of the exhaust port 132*b* in the connection direction is required to a connection portion. Therefore, the duct has a large size in the connection direction. Concretely, the exhaust port 32*b* in the present embodiment as shown in FIG. 6A has the inclining first opening portion 32*b*1 and the straight second opening portions 32*b*2. Therefore, if the exhaust port 32*b* is formed in accordance with the condition of the same width M and a length N of the same connection margin as that of the exhaust port 132*b* as shown in FIG. 6B, a length H1 in the connection direction can be shortened (H1<H2). That is to say, a defect that the second duct (duct) 32 has a large size in the connection direction can be securely eliminated. This causes smooth exhaustion in the exhaust port 32*b* and a required opening area of the duct in space saving to securely form.

Figure 8:
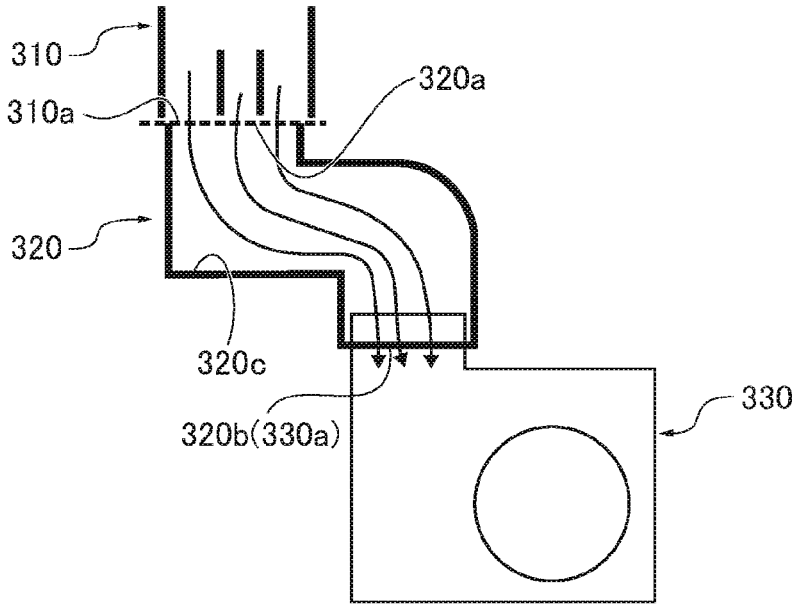
FIG. 8 is a schematic view showing a state where a conventional duct is connected to a separate duct.

Because the exhaust port 32*b* of the second duct 32 is provided with the first opening portion 32*b*1 (inclined portion) configured to incline to the connection direction, an area being in contact with the third duct 33 becomes wide and a sufficient connection force can be secured, compared with a case where an exhaust port 320*b* is opened in a perpendicular direction to the connection direction, as shown in FIG. 8. Note that, in FIGS. 6A and 6B, reference sign W denotes a depth in which the exhaust port 32*b* (132*b*) of the second duct 32 and the suction port 33*a* of the third duct 33 are connected.

In addition, because the exhaust port 32*b* of the second duct 32 is provided with the second opening portions 32*b*2 (straight portions) which is substantially perpendicular to the connection direction and formed to shift in the connection direction to place the first opening portion 32*b*1 (inclined portion) therebetween, defects that the exhaust port 32*b* and the suction port 33*a* deviate when the third duct 33 is connected and a clearance at a connection portion occurs are hard to occur, compared to a case where the exhaust port 320*b* is formed by only the straight portion, as shown in FIG. 8.

The second duct 32 in the embodiment includes an inclined inner wall surface 32*d* extending along the bent passage such that air exhausted from the exhaust port 31*a* of the first duct 31 and introduced in the suction port 32*a* efficiently flows toward the exhaust port 32*b*, as shown in FIG. 5. Therefore, stable air flow having uniform flow quantity without turbulence can be formed, compared with a case where air exhausted from an exhaust port 310*a* of a first duct 310 and introduced in a suction port 320*a* of a second duct 320 impinges on an inner wall surface 320*c* of the second duct 320, which is perpendicular to the passage and follows toward the exhaust port 320*b* of the second duct 320, as shown in FIG. 8.

In addition, in the configuration shown in FIG. 8, the exhaust port 320*b* of the second duct 320 to which the suction port 330*a* of the third duct 330 is connected is not disposed to face the suction port 320*a*. Therefore, smooth air flow from the suction port 320*a* to the exhaust port 320*b* is hard to be formed. On the contrary, the configuration in the embodiment makes it possible to form smooth air flow from the suction port 32*a* to the exhaust port 32*b*, thereby forming stable air flow having uniform flow quantity without turbulence, because the exhaust port 32*b* of the second duct 32 is formed to open facing the suction port 32*a*, as shown in FIG. 5.

Figure 7:
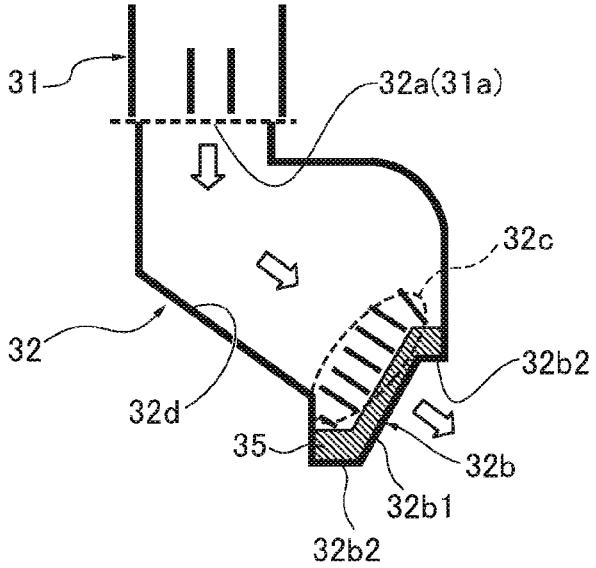
FIG. 7 is a schematic view showing a modification of the duct.

Here, in the embodiment, it is preferable to provide a seal member 35 that seals a clearance between the second duct 32 and the third duct (separate duct) 33 on a circumference (circumference of the first opening portion 32*b*1 and the second opening portions 32*b*2) of the exhaust port 32*b* of the second duct 32, as shown in FIG. 7. More specifically, the seal member 35 is made of a resilient material such as foam polyurethane and a rubber material and so on and can be adhered to an inner wall surface (or outer wall surface) close to the exhaust port 32*b* to correspond to a shape of the exhaust port 32*b* in a range (depth of the connection) of the reference sign W as shown in FIG. 6A. Thereby air is prevented from leaking from the connection portion between the second duct 32 and the third duct 33. Note that, similarly, it is preferable to provide a seal member on a connection portion between the first duct 31 and the second duct 32.

In case of providing the seal member 35 in such a way, it is possible to provide one or a plurality of ribs 32*c* to decide the position of the seal member 35 in the predetermined direction (connection direction) of the seal member 35 at a position (close to the first opening portion 32*b*1 and the second opening portions 32*b*2) close to the exhaust port 32*b* of the second duct 32. In this case, the plurality of ribs 32*c* functions to adjust air flow exhausted from the second duct 32 to the third duct 33, similarly to the foregoing ribs 31*c* of the first duct 31. In other words, the plurality of ribs 32*c* extends in a substantially perpendicular direction to the first opening portion 32*b*1 (inclined portion) in the exhaust port 32*b* and can be formed to support an upstream side of a passage of the seal member 35. In this way, by providing the ribs 32*c*, it is possible to support the seal member 35 by the ribs 32*c* and to thus prevent the seal member 35 from being turned over, when the third duct 33 is connected to the second duct 32.

As described above, in the embodiment, the first opening portion 32*b*1 and the second opening portions 32*b*2 are provided in the exhaust port 32*b* of the second duct (duct) 32 to which the third duct (separate duct) 33 is connected from the predetermined direction. Here, the first opening portion 32*b*1 is opened to incline to the predetermined direction and the second opening portions 32*b*2 are communicated with the both ends of the first opening portion 32*b*1 in the inclined direction of the first opening portion 32*b*1 and opened to the substantially perpendicular direction to the predetermined direction. Thereby it is possible to securely connect the third duct (separate duct) 33 to the second duct 32 with sufficient connection force, without causing a large size in the connection direction and generating a clearance therebetween.

In the embodiment, although the disclosure has been applied to the exhaust route (exhaust device) installed on the monochrome image forming apparatus, of course, the disclosure can be applied to an exhaust route (exhaust device) installed on a color image forming apparatus. Moreover, in the embodiment, although the disclosure has been applied to the exhaust rout (exhaust device) to suck ozone, the configuration of the exhaust device can be applied to a heat-releasing route for the fixing device, other exhaust route or heat-releasing route, or a suction route.

In addition, in the embodiment, although the first opening portion 32*b*1 and the second opening portions 32*b*2 are provided in the exhaust port 32*b* of the duct (second duct 32) (and the suction port 33*a* of the third duct 33), the first opening portion 32*b*1 and the second opening portions 32*b*2 may be provided in the suction port 32*a* of the duct 32 (and the exhaust port 31*a* of the first duct 31), or provided in both the suction port 32*a* and the exhaust port 32*b*. Even in these cases, effects similar to the above effects can be obtained.

Although the embodiment and the alternatives of the disclosure have been described, it should be noted that the disclosure is not limited to these embodiments and the alternatives, various modifications and changes can be made to the embodiments and the alternatives by those skilled in the art as long as such modifications and changes are within the scope of the disclosure as defined by the Claims.

What is claimed is:

1. A duct comprising:

a suction port at a first terminal end of the duct, the suction port being connectable to a first separate duct from a first direction;

an exhaust port at a second terminal end of the duct, the exhaust port being connectable to a second separate duct downstream from the second terminal end of the duct in an air exhausting direction; and a passage formed to extend from the suction port to the exhaust port, wherein at least one of the suction port and the exhaust port includes a central first opening portion that is opened to incline to the first direction, and second opening portions disposed laterally of the central first opening portion, the second opening portions that are opened in a transverse direction to the first direction.

2. The duct according to claim 1, wherein the suction port includes a third opening portion that is opened in a substantially perpendicular direction to the first direction, the exhaust port includes the central first opening portion and the second opening portions, and the central first opening portion is formed to open toward a side where the suction port is formed.

3. The duct according to claim 2, wherein the passage includes a bent portion to bent from the suction port to the exhaust port, wherein the central first opening portion is a substantially perpendicular to the bent portion.

4. The duct according to claim 1, further comprising a seal within the central first opening portion and the second opening portions to seal a clearance between the duct and at least of the first separate duct and the second separate duct.

5. The duct according to claim 4, further comprising at least one rib upstream of the first opening portion of the central first opening portion and the second opening portions in the air exhausting direction and to define a position of the seal in the first direction.

6. An image forming apparatus, comprising an image forming part to form an image;

the duct as claimed in claim 1; wherein the first separate duct connects to the suction port of the duct; and the second separate duct connects to the exhaust port of the duct.

7. The image forming apparatus according to claim 6, further comprising a frame to fix the first separate duct, wherein the first separate duct includes an exhaust port to connect the suction port of the duct.

8. The image forming apparatus according to claim 7, wherein the second separate duct includes a suction fan, the second separate duct is connected to the duct in a substantially perpendicular direction to the frame, as the first direction in a state where the duct is connected to the first separate duct.

9. The duct according to claim 1, wherein the exhaust port has a pair of parallel side walls and the second opening portions extend perpendicularly from the side walls toward the central first opening portion, and the central first opening portion is opened to incline between the second opening portions.

* * * * *